US010281882B2

(12) United States Patent
Honda

(10) Patent No.: US 10,281,882 B2
(45) Date of Patent: May 7, 2019

(54) ELECTRONIC TIMEPIECE, AND CONTROL METHOD OF AN ELECTRONIC TIMEPIECE

(71) Applicant: Seiko Epson Corporation, Tokyo (JP)

(72) Inventor: Katsuyuki Honda, Miyata-Mura (JP)

(73) Assignee: Seiko Epson Corporation (JP)

( * ) Notice: Subject to any disclaimer, the term of this patent is extended or adjusted under 35 U.S.C. 154(b) by 128 days.

(21) Appl. No.: 15/050,617

(22) Filed: Feb. 23, 2016

(65) Prior Publication Data

US 2016/0252889 A1 Sep. 1, 2016

(30) Foreign Application Priority Data

Feb. 26, 2015 (JP) ..... 2015-036970

(51) Int. Cl.
*G04R 20/04* (2013.01)
*G04G 19/10* (2006.01)

(52) U.S. Cl.
CPC ..... *G04R 20/04* (2013.01); *G04G 19/10* (2013.01)

(58) Field of Classification Search
CPC ..... G04R 20/04; G04R 20/02; G04G 19/10; G04G 9/00; G04C 3/00
See application file for complete search history.

(56) References Cited

U.S. PATENT DOCUMENTS 7,079,451 B2 * 7/2006 Okeya ..... G04G 19/12 368/47
7,983,116 B2 * 7/2011 Fujisawa ..... G01S 19/14 368/46
9,084,085 B2 7/2015 Jeon
9,098,071 B2 * 8/2015 Honda ..... G04C 10/02
9,448,542 B2 * 9/2016 Honda ..... G04R 20/04
2013/0051186 A1 * 2/2013 Honda ..... G04R 20/04 368/47
2013/0051188 A1 * 2/2013 Akiyama ..... G04R 20/04 368/47

FOREIGN PATENT DOCUMENTS

JP 2005-351674 A 12/2005
JP 2007-311956 A 11/2007
JP 2013-017181 A 1/2013
JP 2013-205363 A 10/2013

* cited by examiner

*Primary Examiner* — Sean P Kayes
(74) *Attorney, Agent, or Firm* — Harness, Dickey & Pierce, P.L.C.

(57) ABSTRACT

An electronic timepiece has a reception device; an input device; a detection device that detects a start reception operation of the input device and outputs a start reception signal; a manual reception controller that operates the receiver and executes a reception process if the start reception signal output from the detection device is received; an automatic reception controller that determines if an automatic reception condition is met, and operates the reception device to execute the reception process if the automatic reception condition is met; and a reception setter that enables or disables operation of the automatic reception controller. The reception setter enables operation of the automatic reception controller if the start reception signal output from the detection device is received if operation of the automatic reception controller is disabled.

12 Claims, 11 Drawing Sheets

ELECTRONIC TIMEPIECE, AND CONTROL METHOD OF AN ELECTRONIC TIMEPIECE

CROSS-REFERENCE TO RELATED APPLICATION(S)

This application claims priority under 35 U.S.C. § 119 on Japanese Patent Application No. 2015-036970, filed Feb. 26, 2015. The content of this priority application is incorporated by reference in its entirety.

BACKGROUND

1. Technical Field

The present invention relates to an electronic timepiece and a control method of an electronic timepiece that receives satellite signals and measures time.

2. Related Art

Electronic timepieces that receive and acquire time information from satellite signals transmitted from GPS (Global Positioning System) satellites, update the internal time based on the acquired time information, and have an automatic reception function for automatically receiving satellite signals when a particular automatic reception condition is met are known from the literature. See, for example, JP-A-2013-205363.

When a means of changing the operating mode of the timepiece is pushed in the timepiece described in JP-A-2013-205363, the mode can be changed between an automatic reception enabled mode (timekeeping mode, positioning mode) and an automatic reception disabled mode. When automatic reception is enabled, satellite signals are automatically received on a regular schedule.

Use of GPS receivers on commercial airplanes during take-off and landing is commonly prohibited, and the user must disable automatic reception after boarding the plane and then re-enable automatic reception after landing. Enabling such automatic reception should therefore be simple.

SUMMARY

An electronic timepiece and a control method of an electronic timepiece enable the user to enable automatic reception by a simple operation.

An electronic timepiece according to one aspect has a receiver configured to receive satellite signals; an interface; a detector configured to detect a start reception operation of the interface instructing starting reception, and outputting a start reception signal if the start reception operation is detected; a manual reception controller configured to operate the receiver and execute the reception process if the start reception signal is received from the detector; an automatic reception controller configured to determine if an automatic reception condition for receiving satellite signals is met, and operating the receiver to execute the reception process if the automatic reception condition is met; and a reception setter configured to enable or disable operation of the automatic reception controller. The reception setter enables operation of the automatic reception controller if the start reception signal output from the detector is received if operation of the automatic reception controller is disabled.

If operation of the automatic reception controller is disabled but the start reception operation is performed with the interface, the detector detects the operation and outputs the start reception signal. If the start reception signal is received, the reception setter enables operation of the automatic reception controller.

Thus comprised, because operation of the automatic reception controller is enabled if the user travels by airplane to a different location and then executes the start reception operation to adjust the time kept by the electronic timepiece to the current local time, there is no need to perform a separate operation to enable operation of the automatic reception controller, and operation can be simplified.

Further preferably in an electronic timepiece according to another aspect, the detector detects a display reception result operation of the interface instructing displaying the reception result, and outputs a display reception result signal if the display reception result operation is detected; and the reception setter enables operation of the automatic reception controller if operation of the automatic reception controller is disabled and the display reception result signal is received from the detector.

If operation of the automatic reception controller is turned off and the interface is manipulated in the display reception result operation, the detector detects the operation and outputs the display reception result signal. The reception setter then enables operation of the automatic reception controller if the display reception result signal is received.

Thus comprised, if the user reaches a destination by plane, adjusts the time kept by the electronic timepiece to the local time, and executes the display reception result operation to check the reception result, operation of the automatic reception controller is automatically enabled. Operation is thus simplified because the user does not need to perform a separate operation to turn the automatic reception controller on.

Because operation of the automatic reception controller can be enabled without running the reception process, power consumption can be reduced compared with if operation of the automatic reception controller is enabled if the start reception operation is performed.

In an electronic timepiece according to another aspect, the interface includes an operating button; and the detector detects the display reception result operation if the operating button is pushed for a previously set first time, and detects the start reception operation if the operating button is pushed for a second time that is longer than the first time.

If the operating button is pushed for 1 second or more and less than 3 seconds, the detector detects the display reception result operation, and detects the start reception operation if the operating button is pushed for 3 seconds or more.

Because the start reception operation and the display reception result operation that enable operation of the automatic reception controller are performed using the same operating button, remembering the operation for enabling the automatic reception controller is easier for the user than if the operations are performed with different buttons.

In an electronic timepiece according to another aspect, the reception setter enables operation of the automatic reception controller if the reception process executed by the manual reception controller in response to the start reception signal is successful if operation of the automatic reception controller is disabled, and keeps operation of the automatic reception controller disabled if the reception process of the manual reception controller fails if operation of the automatic reception controller is disabled.

If the reception process of the manual reception controller succeeds, the reception process can be expected to succeed if the automatic reception controller executes the reception process if the automatic reception condition is met even if the operating environment of the electronic timepiece has not changed. As a result, the chance of the automatic reception controller succeeding in the reception process can be improved by enabling operation of the automatic reception controller if the reception process of the manual reception controller succeeds.

Furthermore, if the operating environment of the electronic timepiece does not change after the reception process of the manual reception controller fails, the reception process can be expected to fail even if the automatic reception controller runs the reception process if the automatic reception condition is met. As a result, by disabling operation of the automatic reception controller if the reception process of the manual reception controller fails, the automatic reception controller running the reception process in an environment not suited to signal reception can be avoided, and power consumption can be reduced.

An electronic timepiece according to another aspect has a receiver configured to receive satellite signals; an interface; a detector configured to detect a display reception result operation of the interface instructing indicating the reception result, and output a display reception result signal if the display reception result operation is detected; an automatic reception controller configured to determine if an automatic reception condition for receiving satellite signals is met, and operate the receiver to execute the reception process if the automatic reception condition is met; and a reception setter configured to enable or disable operation of the automatic reception controller. The reception setter enables operation of the automatic reception controller if the display reception result signal output from the detector is received if operation of the automatic reception controller is disabled.

Because operation of the automatic reception controller is enabled in conjunction with the display reception result operation performed by the user after reaching a destination by airplane, a separate operation is not needed to enable operation of the automatic reception controller, and operation is therefore simplified.

Furthermore, because operation of the automatic reception controller can be enabled without executing the reception process, power consumption can be reduced compared with enabling operation of the automatic reception controller if the start reception operation is performed.

An electronic timepiece according to another aspect preferably also has a battery; a power reserve detector configured to detect the capacity remaining in the battery; and a reception prevention controller configured to block operation of the automatic reception controller if the output of the power reserve detector is less than a previously set power reserve threshold, and to cancel blocking operation of the automatic reception controller if the output of the power reserve detector is greater than or equal to the power reserve threshold. The automatic reception controller does not execute the reception process even if the automatic reception condition is met if operation is enabled by the reception setter and operation is blocked by the reception prevention controller; and the reception setter enables operation of the automatic reception controller whether or not operation of the automatic reception controller is blocked by the reception prevention controller if the start reception signal or the display reception result signal output from the detector is received if operation of the automatic reception controller is disabled.

If operation of the automatic reception controller is enabled by the reception setter but the output of the power reserve detector is less than a power reserve threshold and operation of the automatic reception controller is blocked by the reception prevention controller, the reception process does not execute even if the automatic reception condition is met. The reception process running if the power reserve is low and a system shutdown occurring as a result can therefore be avoided.

If operation of the automatic reception controller is disabled and a start reception signal or display reception result signal is received, the reception setter enables operation of the automatic reception controller even if operation of the automatic reception controller is blocked by the reception prevention controller. As a result, if the battery is rechargeable, there is no need for the user to repeat the operation enabling operation of the automatic reception controller after the battery is charged. Furthermore, if the battery is charged and the output value of the power reserve detector is greater than or equal to the power reserve threshold, the automatic reception controller can immediately go to the state enabling executing the reception process.

An electronic timepiece according to another aspect preferably also has a battery; a power reserve detector configured to detect the capacity remaining in the battery; and a reception prevention controller configured to block operation of the automatic reception controller if the output of the power reserve detector is less than a previously set power reserve threshold, and to cancel blocking operation of the automatic reception controller if the output of the power reserve detector is greater than or equal to the power reserve threshold. The automatic reception controller does not execute the reception process even if the automatic reception condition is met if operation is enabled by the reception setter and operation is blocked by the reception prevention controller. The reception setter enables operation of the automatic reception controller if the start reception signal or the display reception result signal output from the detector is received if operation of the automatic reception controller is disabled and operation of the automatic reception controller is not blocked by the reception prevention controller, and keeps operation of the automatic reception controller disabled if the start reception signal or the display reception result signal output from the detector is received if operation of the automatic reception controller is disabled and operation of the automatic reception controller is blocked by the reception prevention controller.

If operation is enabled by the reception setter, the output of the power reserve detector is less than the power reserve threshold, and operation is blocked by the reception prevention controller, the automatic reception controller does not execute the reception process even if the automatic reception condition is met, and a system shutdown resulting from the reception process running if the battery capacity is low can be prevented.

The reception setter also keeps operation of the automatic reception controller disabled if the start reception signal or the display reception result signal is received if operation of the automatic reception controller is disabled and operation of the automatic reception controller is blocked by the reception prevention controller.

Whether operation of the automatic reception controller is enabled or disabled can be displayed by the display unit of the electronic timepiece.

If operation of the automatic reception controller is enabled if operation of the automatic reception controller is blocked by the reception prevention controller, the user could mistakenly think that the automatic reception controller can execute the reception process even though operation of the automatic reception controller is blocked. However, because this aspect does not enable operation of the automatic reception controller if operation of the automatic reception controller is prohibited, the user mistakenly thinking that the automatic reception controller can execute the reception process can be avoided.

An electronic timepiece according to another aspect preferably also has a display; and a display controller configured to display on the display unit that operation of the automatic reception controller is disabled if operation of the automatic reception controller is disabled.

Because the user can confirm that operation of the automatic reception controller is disabled, the user can know if the user has forgotten to enable operation of the automatic reception controller, and can enable operation of the automatic reception controller by performing the start reception operation or the display reception result operation.

An electronic timepiece according to another aspect preferably also has a luminance detector configured to detect the brightness of light incident to the electronic timepiece; the automatic reception controller executing the reception process if the luminance detected by the luminance detector is greater than or equal to a previously set luminance threshold.

Thus comprised, the reception process is executed if the luminance of light incident to the electronic timepiece is greater than or equal to a luminance threshold and the electronic timepiece can be determined to be exposed to sunlight, that is, the electronic timepiece is outdoors. The chance of reception is attempted if outdoors is therefore high, and time information can be acquired with a relatively high probability of success.

An electronic timepiece according to another aspect preferably also has a timekeeper configured to keep time; and the automatic reception controller executes the reception process if the kept time of the timekeeper reaches a previously set specific time.

Thus comprised, the reception process can be executed at the scheduled time whether or not the electronic timepiece is outdoors and the reception process cannot be executed based on the luminance of light because the electronic timepiece is covered by a sleeve, for example.

Another aspect is a control method of an electronic timepiece including a receiver configured to receive satellite signals; an interface; a detector configured to detect a start reception operation of the interface instructing starting reception, and outputting a start reception signal if the start reception operation is detected; a manual reception controller configured to operate the receiver and execute the reception process if the start reception signal is received from the detector; and an automatic reception controller configured to determine if an automatic reception condition for receiving satellite signals is met, and operating the receiver to execute the reception process if the automatic reception condition is met. The control method includes: disabling operation of the automatic reception controller; and enabling operation of the automatic reception controller if the start reception signal is output from the detector if operation of the automatic reception controller is disabled.

The control method of an electronic timepiece according to this aspect has the same effect as the electronic timepiece described above.

Another aspect is a control method of an electronic timepiece including a receiver configured to receive satellite signals; an interface; a detector configured to detect a display reception result operation of the interface instructing indicating the reception result, and output a display reception result signal if the display reception result operation is detected; and an automatic reception controller configured to determine if an automatic reception condition for receiving satellite signals is met, and operate the receiver to execute the reception process if the automatic reception condition is met. The control method includes: disabling operation of the automatic reception controller; and enabling operation of the automatic reception controller if the display reception result signal is output from the detector if operation of the automatic reception controller is disabled.

The control method of an electronic timepiece according to this aspect has the same effect as the electronic timepiece described above.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Embodiment 1

Basic Configuration of a GPS System Including an Electronic Timepiece

Figure 1:
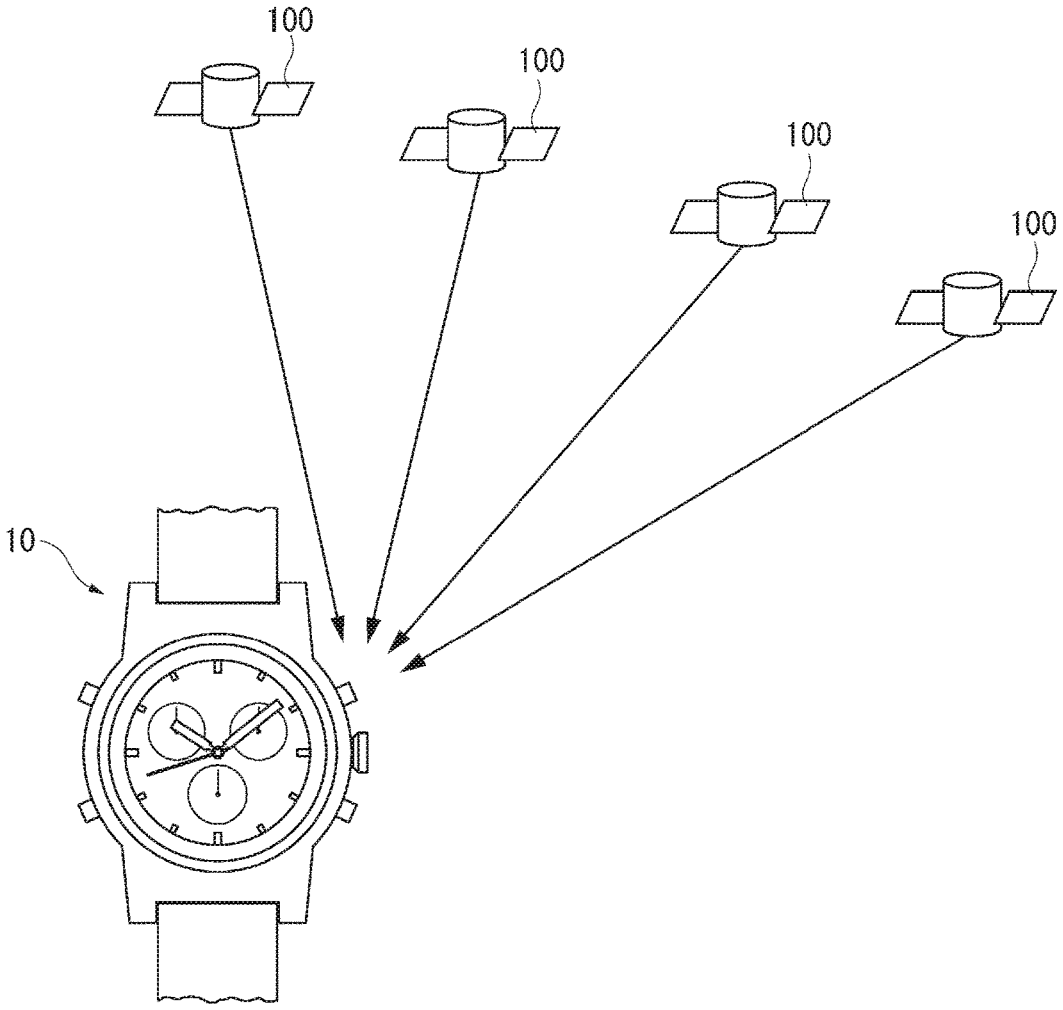
FIG. 1 schematically illustrates use of an electronic timepiece according to a first embodiment.

FIG. 1 illustrates a GPS system including an electronic timepiece 10. The basic configuration of the GPS system whereby an electronic timepiece 10 acquires location information and time information for the current location from satellite signals is described first.

The electronic timepiece 10 in this embodiment is a wristwatch that receives satellite signals (RF signals) from GPS satellites 100 and adjusts the internal time, and displays the current time based on the satellite signals on the opposite side of the wristwatch (the face) as the side of the wristwatch worn in contact with the wrist (the back).

The GPS satellites 100 are navigational satellites that orbit the Earth in space on specific orbits, and broadcast a navigation message superimposed on a 1.57542 GHz carrier wave (L1 wave). For brevity below, the 1.57542 GHz carrier wave to which the navigation message is superimposed is referred to as the satellite signal. The satellite signals are right-hand circularly polarized waves.

There are presently approximately 30 GPS satellites 100 in orbit (only 4 are shown in FIG. 1), and to identify which of the GPS satellites 100 transmitted the received satellite signal, a unique 1023 chip (1 ms) pattern called a C/A code (Coarse/Acquisition Code) is superimposed by each GPS satellite 100. Each chip in the C/A code denotes a +1 or −1, and the C/A code appears as a pseudorandom pattern. Therefore, by determining the correlation between the satellite signal and the pattern of each C/A code, the C/A code superimposed in a particular satellite signal can be detected.

Each GPS satellite 100 carries an atomic clock, and extremely precise GPS time information that is kept by the atomic clock is embedded in each satellite signal. The slight time difference between the atomic clocks carried by the GPS satellites 100 is measured by a land-based control segment, and a time correction parameter for correcting the particular time difference is included in each satellite signal.

The electronic timepiece 10 receives a satellite signal transmitted from one GPS satellite 100, and sets the internal time of the electronic timepiece 10 to the precise time (time information) obtained using the GPS time information and time correction parameter contained in the received satellite signal.

Orbit information identifying the location of the GPS satellite 100 on its orbit is also contained in the satellite signal. The electronic timepiece 10 performs a positioning calculation using the GPS time information and orbit information. This positioning calculation assumes there is a certain amount of error in the internal time of the electronic timepiece 10.

More specifically, in addition to the x, y, z parameters for acquiring the location of the electronic timepiece 10 in three dimensions, the time difference is also an unknown variable. The electronic timepiece 10 therefore generally receives satellite signals transmitted from four or more GPS satellites 100, and runs the positioning calculation using the GPS time information and orbit information contained in the received satellite signals to determine the location information of the current location.

Configuration of the Electronic Timepiece

Figure 2:
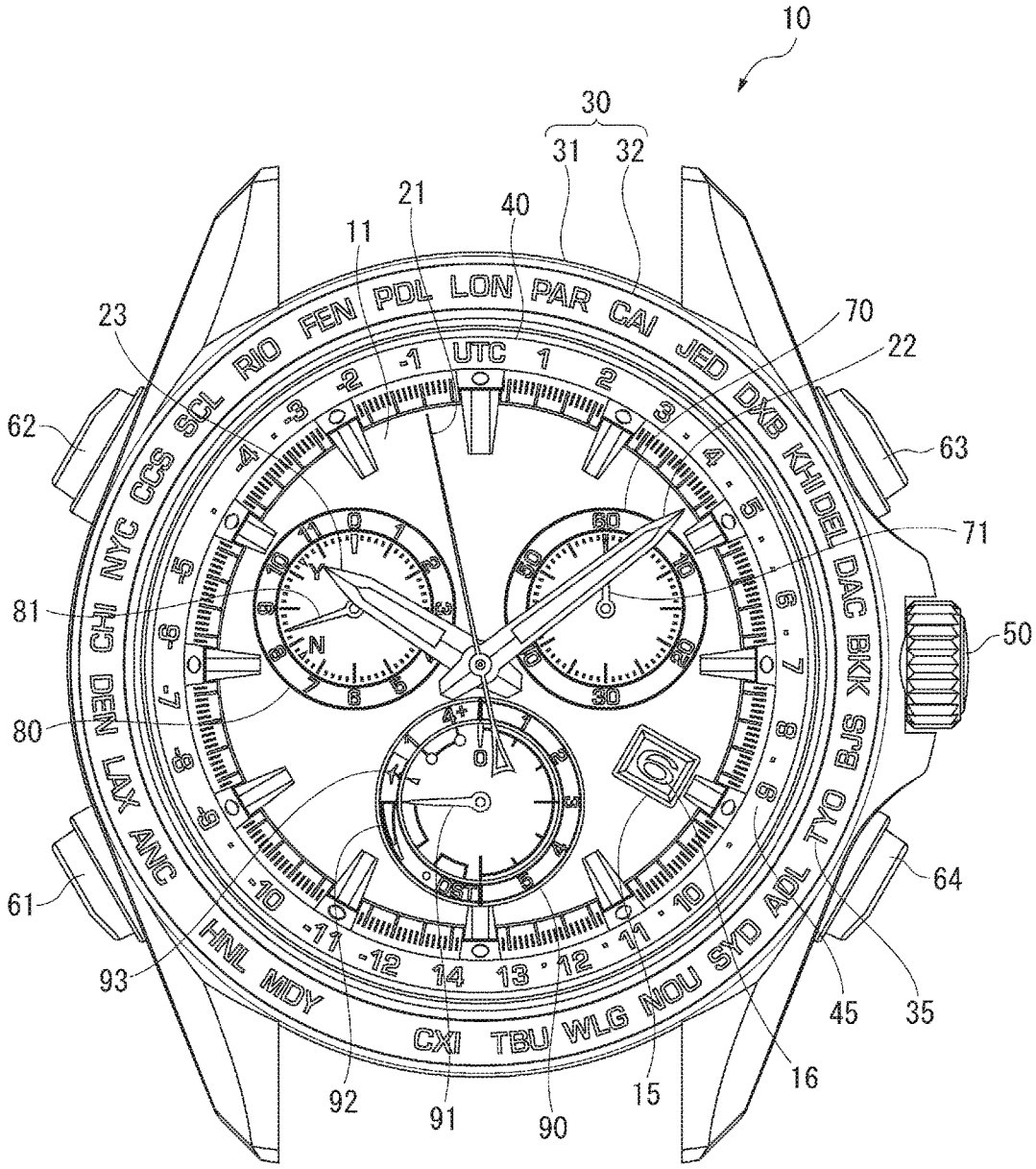
FIG. 2 is a plan view of the electronic timepiece according to the first embodiment.
Figure 3:
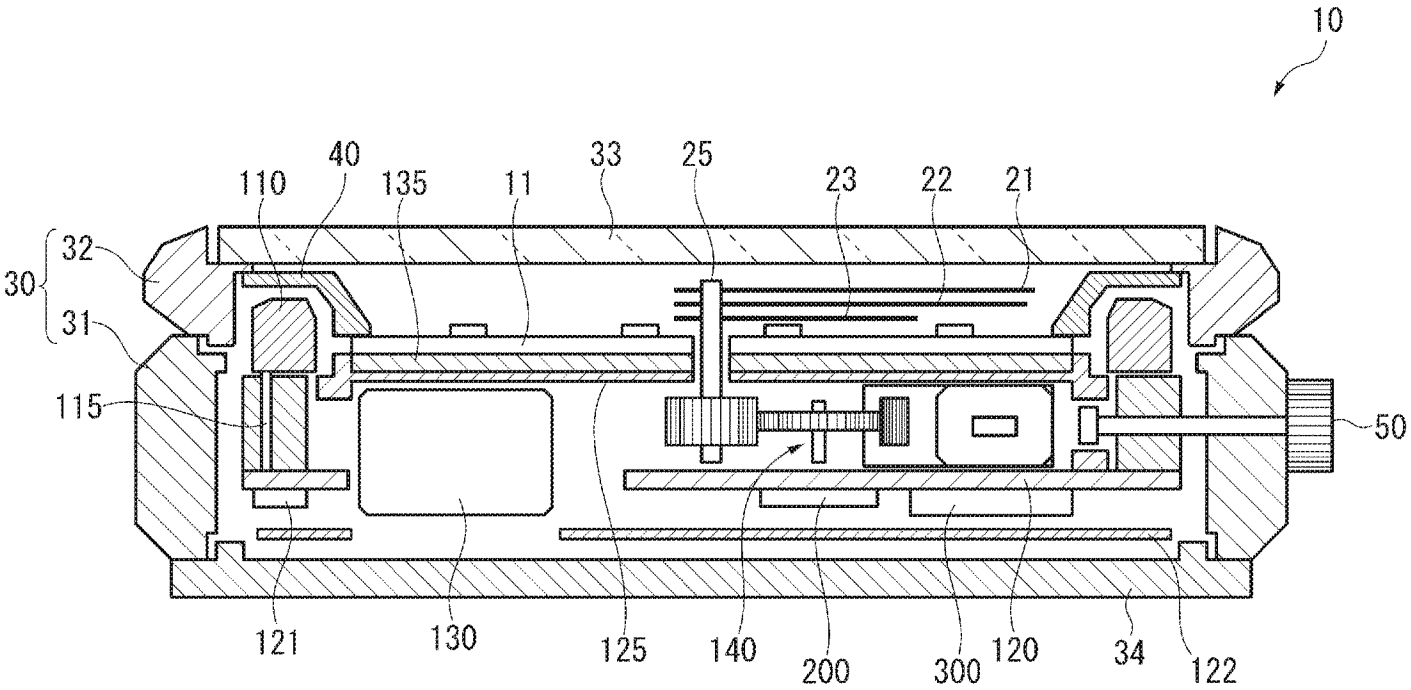
FIG. 3 is a section view of the electronic timepiece according to the first embodiment.

FIG. 2 is a plan view of the face of the electronic timepiece 10, and FIG. 3 is a section view of the electronic timepiece 10.

As shown in FIG. 2 and FIG. 3, the electronic timepiece 10 has an external case 30, crystal 33, and back cover 34.

The external case 30 includes a ceramic bezel 32 affixed to a cylindrical case member 31 made of metal. A round dial 11 for displaying the time is held inside the inside circumference of the bezel 32 by means of a plastic dial ring 40.

Hands 21, 22, 23 are disposed above the dial 11. Around the center of the dial 11 are further disposed a round first subdial 70 and hand 71 at 2:00; a round second subdial 80 and hand 81 at 10:00; a round third subdial 90 and hand 91 at 6:00; and a rectangular calendar window 15 at 4:00. The dial 11, hands 21, 22, 23, first subdial 70, second subdial 80, third subdial 90, and calendar window 15 can be seen through the crystal 33.

A calendar wheel 16 (date wheel) is disposed on the back side of the dial 11, and this calendar wheel 16 can be seen through the calendar window 15.

In the side of the external case 30 around the center of the dial 11 are also disposed a button A 61 at 8:00; a button B 62 at 10:00; a button C 63 at 2:00; a button D 64 at 4:00; and a crown 50 at 3:00. When the button A 61, button B 62, button C 63, button D 64, and crown 50 are operated, operating signals corresponding to the specific operation are output.

As shown in FIG. 3, of the two main openings in the metal external case 30, the opening on the face side of the electronic timepiece 10 is covered by the crystal 33 held by the intervening ceramic bezel 32, and the opening on the back side is covered by the metal back cover 34.

Disposed inside the external case 30 are the dial ring 40 attached to the inside circumference of the ceramic bezel 32; a light transparent dial 11; a center arbor 25 that passes through the dial 11; the hands 21, 22, 23 that rotate on the center arbor 25; and a drive mechanism 140 that drives the hands 21, 22, 23, the hands 71, 81, 91, and the calendar wheel 16.

The center arbor 25 passes through the plane center of the external case 30 on the center axis between the face and back of the timepiece.

The dial ring 40 has a flat portion of which the outside edge contacts the inside circumference surface of the ceramic bezel 32 and one surface is parallel to the crystal 33; and a beveled portion that slopes toward the dial 11 so that the inside edge contacts the dial 11. The dial ring 40 is ring-shaped when seen in plan view, and conically shaped when seen in section view. A donut-shaped storage space is formed by the flat portion and the beveled portion of the dial ring 40, and the inside circumference surface of the ceramic bezel 32. A ring-shaped antenna 110 is housed in this storage space.

The antenna 110 has a ring-shaped dielectric base on which a metal antenna pattern is formed by a plating or silver paste printing process. The antenna 110 is disposed around the perimeter of the dial 11 and the inside circumference side of the ceramic bezel 32, is covered by the plastic dial ring 40 and crystal 33, and can therefore assure good reception. The dielectric in this embodiment is molded from a titanium oxide or other high frequency dielectric material mixed with resin, and enables rendering a small antenna by using the wavelength-shortening effect of the dielectric.

The dial 11 is a round disc for indicating the time inside the external case 30, is made from plastic or other light transmissive material, and is disposed inside the dial ring 40 with the hands 21, 22, 23 between the dial 11 and the crystal 33.

A photovoltaic solar panel 135 is disposed between the dial 11 and the main plate 125 to which the drive mechanism 140 is attached. The solar panel 135 is a round panel having a plurality of solar cells (photovoltaic elements) that convert light energy to electrical energy connected in series. Holes through which the center arbor 25, arbors (not shown in the figure) for the hand 71 of the first subdial 70, the hand 81 of the second subdial 80, and the hand 91 of the third subdial 90 pass, and the aperture of the calendar window 15, are formed in the dial 11, the solar panel 135, and the main plate 125.

The drive mechanism 140 is attached to the main plate 125, and is covered on the back side by a circuit board 120. The drive mechanism 140 has a stepper motor, wheels and wheel trains, and drives the hands by the stepper motor turning the center arbor 25 through the wheel train.

The drive mechanism 140 more specifically includes first to sixth drive mechanisms. The first drive mechanism drives the minute hand 22 (minute hand) and hour hand 23 (hour hand) that indicate the hour and minute of the internal time (current time). The second hand 21, the hand 71 of the first subdial 70, the hand 81 of the second subdial 80, and the hand 91 of the third subdial 90 are driven by like drive mechanisms (not shown in the figure). More specifically, the second drive mechanism drives the second hand 21 (chronograph second hand) that indicates the second of the chronograph function; the third drive mechanism drives the hand 71 (chronograph minute hand) that indicates the minute of the chronograph function; the fourth drive mechanism drives the hand 81 (small second hand) that indicates the second of the internal time; the fifth drive mechanism drives the hand 91 (chronograph hour hand) that indicates the hour of the chronograph function; and the sixth drive mechanism drives the calendar wheel 16 that is visible through the calendar window 15.

The circuit board 120 has a reception device (GPS module) 121, a control device 300, and a storage device 200. The circuit board 120 and antenna 110 connect through an antenna connection pin 115. A circuit cover 122 covers the reception device 121, control device 300, and storage device 200 from the back cover 34 side of the circuit board 120 to which these parts are disposed. A lithium ion battery or other type of storage battery 130 is disposed between the main plate 125 and the back cover 34. The storage battery 130 is charged with power produced by the solar panel 135.

Electronic Timepiece Display Mechanism

As shown in FIG. 2, a scale dividing the outside circumference into 60 divisions, each of which is subdivided into a ⅕ scale of 5 divisions, is formed around the outside perimeter of the dial 11. Using this scale, the second hand 21 indicates the seconds of the chronograph time, the minute hand 22 indicates the minute of the internal time, and the hour hand 23 indicates the hour of the internal time.

A scale of 60 divisions with numeric markers 10 to 60 at increments of 10 are disposed around the outside of the round first subdial 70 on the dial 11. The hand 71 of this first subdial 70 uses this scale to indicate the minute of the chronograph function.

A scale of 60 divisions with numeric markers 0 to 11 is disposed around the outside of the round second subdial 80 on the dial 11. The hand 81 of this second subdial 80 uses this scale to indicate the second of the internal time.

The letter Y is disposed to the 52-second position and the letter N is disposed to the 38-second position of the second subdial 80. These letters are used to indicate the result of receiving (acquiring) information based on the satellite signals received from the satellites (Y=reception (acquisition) successful, N=reception (acquisition) failed). If the user pushes operating button B 62 for 1 second or more and less than 3 seconds, the hand 81 jumps to either Y or N to indicate the result of satellite signal reception.

The information indicated using the third subdial 90 of the dial 11 is described next. Note that below referring to the direction of n:00 (where n is a natural number) on the third subdial 90 means the position of that time on an imaginary clock dial centered on the pivot of the hand 91.

A scale of six divisions with numeric markers 0 to 5 is formed on the outside perimeter of the third subdial 90 from 12:00 to 6:00. Using this scale, the hand 91 indicates the hour of the chronograph function.

The letters DST and an open circle (O) are disposed to the third subdial 90 in the area from 6:00 to 7:00. DST denotes Daylight Saving Time. These markers are used to indicate if daylight saving time is being used (DST=the daylight savings time mode is on; 0 indicates the DST mode is off).

A sickle-shaped marker 92 that is wide at the base at 9:00 and narrows to the end at 7:00 is disposed along the outside edge of the third subdial 90 from 7:00 to 9:00. This marker 92 is a power indicator for the storage battery 130 (FIG. 3), and the hand 91 indicates a position at the base, middle, or distal end of the marker 92 according to the reserve power in the storage battery 130. The hand 91 normally points to a position on this marker 92.

An airplane-shaped marker 93 is disposed in the area between 9:00 and 10:00 on the outside of the third subdial 90. This airplane marker 93 denotes an in-flight mode. Satellite signal reception is prohibited in some countries by aviation regulations during take-off and landing of an airplane.

The function (automatic reception function) whereby the electronic timepiece 10 automatically receives satellite signals can be disabled (turned off) by the user pressing button A 61 for at least 3 seconds and setting the hand 91 to the airplane marker 93 (in-flight mode). The automatic reception function can be re-enabled (turned on) by pressing button A 61 for at least 3 seconds again.

The automatic reception function can also be enabled by pressing button B 62 for at least 1 second. The method of turning the automatic reception function on and off is described below in detail.

Numeric markers 1 and 4+ are disposed in the area from 10:00 to 12:00 on the outside of the third subdial 90. These markers are used to indicate the satellite signal reception mode. The 1 marker means that the GPS time information is received and the internal time corrected, and the 4+ marker means that GPS time information and orbit information are received, and the internal time and time zone described below are corrected.

The user can also set the reception mode by operating button A 61. More specifically, the time information reception mode (timekeeping mode) is set by setting the hand 91 to the 1 marker. The positioning information reception mode (positioning mode) is set by setting the hand 91 to the 4+ marker.

The calendar window 15 is a rectangular opening formed in the dial 11, and a number on the calendar wheel 16 can be seen through the calendar window 15. This number indicates the day value of the date.

Time difference information 45 representing the time difference to UTC is indicated by numbers and non-numeric markers on the dial ring 40 surrounding the outside perimeter of the dial 11 along the time scale of minute and second markers on the dial 11. The numeric time difference information 45 denotes the integer value of the time difference, and the non-numeric time difference information 45 denotes a time difference that is not a whole number. The time difference between UTC and the internal time indicated by hands 22, 23, 81 can be checked by the time difference information 45 indicated by the second hand 21 by operating the crown 50.

City name information 35 is disposed beside the time difference information 45 on the bezel 32 surrounding the dial ring 40. The city name information 35 denotes the name of a city located in the time zone that uses the standard time corresponding to the time difference indicated by the time difference information 45 on the dial ring 40.

Electrical Configuration of Electronic Timepiece

Figure 4:
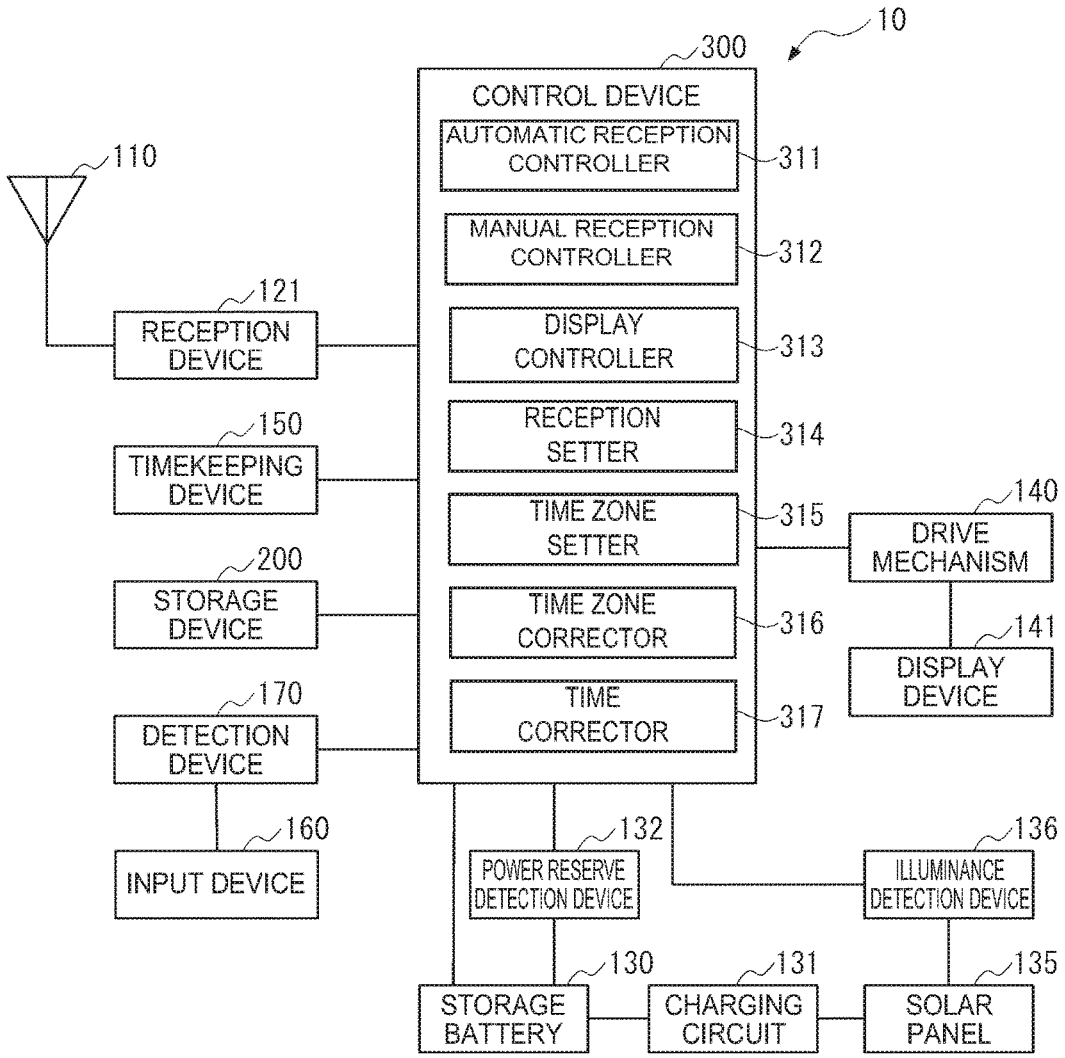
FIG. 4 is a block diagram of the electrical control circuit of the electronic timepiece according to the first embodiment.

FIG. 4 is a control block diagram of the electronic timepiece 10.

As shown in FIG. 4, the electronic timepiece 10 has a control device (controller) 300 comprising a CPU, a storage device 200 including RAM (random access memory) and ROM (read-only memory), a reception device 121 (GPS module), a timekeeping device 150, an input device 160, a detection device 170, the drive mechanism 140, and a display device 141. These devices communicate with each other over a data bus.

The input device 160 includes the crown 50, button A 61, button B 62, button C 63, and button D 64 shown in FIG. 2. The input device 160 is an example of the interface, and button B 62 is an example of the operating button.

The detection device 170 detects operations instructing executing specific processes based on operation of the buttons 61 to 64, and outputs operating signals corresponding to the detected operations to the control device 300. The detection device 170 is an example of the detector.

The display device 141 includes the dial ring 40, bezel 32, and hands 21, 22, 23, 71, 81, 91 shown in FIG. 2. The display device 141 is an example of a display.

The electronic timepiece 10 has a rechargeable storage battery 130 (see FIG. 3) as the power source. The storage battery 130 is charged by power produced by the solar panel 135 through a charging circuit 131.

The electronic timepiece 10 also has a power reserve detection device 132 for detecting the remaining capacity of the storage battery 130. The power reserve detection device 132 detects the reserve capacity of the storage battery 130 at a predetermined time interval. The power reserve detection device 132 may detect the remaining battery capacity by detecting the voltage of the storage battery 130, the charging current, or the discharge current, for example. The power reserve detection device 132 is an example of the battery reserve detector.

Reception Device

The reception device 121 is connected to the antenna 110, processes satellite signals received through the antenna 110, and acquires GPS time information and positioning information. The antenna 110 receives satellite signals that are transmitted from the GPS satellites 100 (FIG. 1) orbiting the Earth on known orbits, and pass through the crystal 33 and dial ring 40 shown in FIG. 3. The reception device 121 is an example of the receiver.

While not shown in the figure, the reception device 121 includes an RF (radio frequency) circuit that receives and converts satellite signals transmitted from the GPS satellites 100 (FIG. 1) to digital signals; a baseband circuit that executes a reception signal correlation process and demodulates the navigation data message; and a data acquisition that acquires GPS time information and positioning information from the navigation data message (satellite signals) demodulated by the baseband circuit.

The RF circuit includes a bandpass filter, PLL circuit, IF filter, VCO (voltage controlled oscillator), ADC (A/D converter), mixer, LNA (low noise amplifier), and IF amplifier.

The satellite signal extracted by the bandpass filter is amplified by the LNA, mixed by the mixer with the signal from the VCO, and down-converted to an IF (intermediate frequency) signal. The IF signal mixed by the mixer then passes through the IF amplifier and IF filter, and is converted by the A/D converter to a digital signal.

The baseband circuit has a local code generator and a correlation calculator.

The local code generator generates local codes that are the same as the C/A codes used by the GPS satellites 100 for signal transmission.

The correlation calculator calculates the correlation between the local codes and the reception signal output from the RF circuit. If the correlation calculated by the correlation calculator equals or exceeds a specific threshold, the C/A code used in the received satellite signal and the local code that was generated match, and the satellite signal can be locked (synchronized). The navigation message can therefore be demodulated by the correlation process using the received satellite signal and a local code.

The data acquisition acquires the GPS time information and location (positioning) information from the navigation message demodulated by the baseband circuit. The navigation message contains preamble data, the TOW (Time of Week, also called the Z count) of the HOW word, and subframe data. There are five subframes, subframe 1 to subframe 5, and each subframe contains satellite correction data including a week number value and satellite health data, ephemeris data (detailed orbit information for a particular GPS satellite 100), and almanac data (basic orbit information for all GPS satellites 100). The data acquisition can therefore acquire the GPS time information and positioning information by extracting specific data from the received navigation message.

Subframes 4 and 5 contain orbit information for all satellites (almanac data) and ionospheric correction information, and this information is stored in subframes 4 and 5 over multiple pages because of the large amount of information. More specifically, the data carried in subframes 4 and 5 is divided over pages 1 to 25, and different page content is sequentially transmitted in each frame. Because 25 frames are required to transmit the content of all pages, 12 minutes 30 seconds is required to receive all of the information in the navigation message.

The leap second value is contained in page 18 of subframe 4, and the leap second information can be acquired by receiving page 18 in subframe 4.

Timekeeping Device

The timekeeping device 150 includes a crystal oscillator that is driven by power stored in the storage battery 130, and updates the time data using a reference signal based on the oscillation signal from the crystal oscillator. The timekeeping device 150 is an example of the timekeeper.

Storage Device

Figure 5:
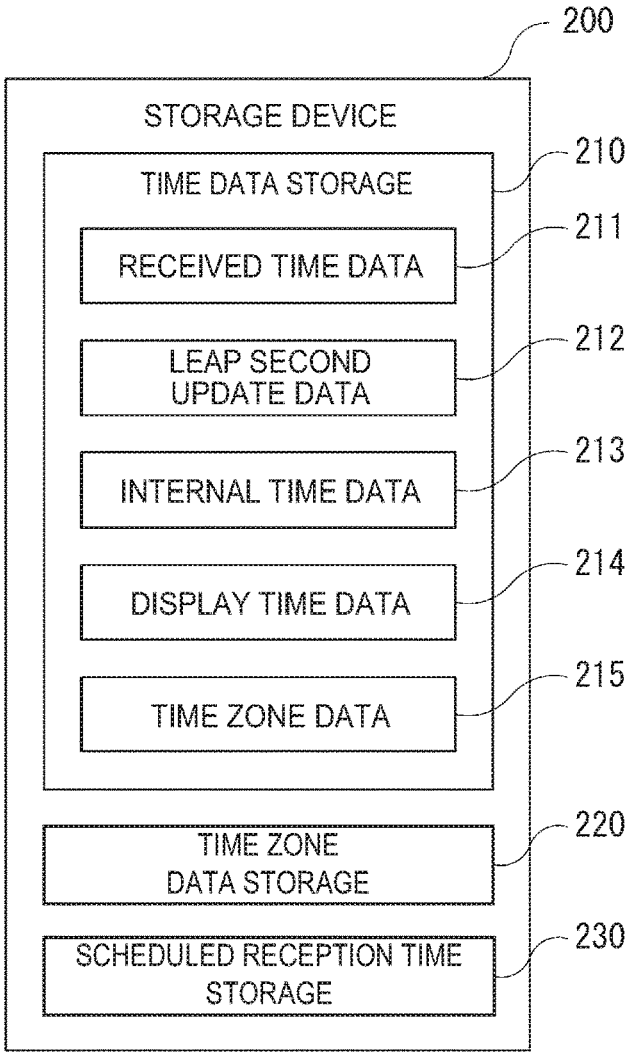
FIG. 5 illustrates the data structure of the storage device of the electronic timepiece according to the first embodiment.

The storage device 200, as shown in FIG. 5, includes a time data storage 210, a time zone data storage 220, and a scheduled reception time storage 230.

Stored in the time data storage 210 are received time data 211, leap second update data 212, internal time data 213, display time data 214, and time zone data 215.

The received time data 211 stores the time information (GPS time) acquired from GPS satellite signals. The received time data 211 is normally updated every second by the timekeeping device 150, and when a satellite signal is received, the acquired time information (GPS time) is stored.

The leap second update data 212 stores at least data about the current leap second. More specifically, the current leap second value, the week number of the leap second event, the day number of the leap second event, and the future leap second value, are stored on page 18 in subframe 4 of the GPS satellite signal as data related to the leap second. Of these values, at least the current leap second value is stored in the leap second update data 212.

More specifically, the internal time data 213 is updated based on the GPS time stored in the received time data 211 and the current leap second value stored in the leap second update data 212. As a result, UTC is stored in the internal time data 213. When the received time data 211 is updated by the timekeeping device 150, the internal time data is also updated.

The sum of the internal time stored in the internal time data 213, and the time zone data (time difference information) of the time zone data 215 is stored in the display time data 214. The time zone data 215 is set based on the positioning information acquired when the time zone is manually selected by the user or is acquired by reception in the navigation mode. This time data is an example of the kept time.

The time zone data storage 220 relationally stores positioning information (latitude, longitude) to time zone data (time difference information). As a result, when positioning information is acquired in the navigation mode, the control device 300 can acquire the time zone based on the positioning information (latitude, longitude).

City names and time zone data are also relationally stored in the time zone data storage 220. As a result, when the user uses the input device 160, such as the crown 55, to select the name of a particular city and acquire the current time in that city, the control device 300 searches the time zone data storage 220 for the city name selected by the user, acquires the time zone data for that city name, and set the time zone data 215.

The scheduled reception time for running the scheduled reception process automatically as described below is stored in the scheduled reception time storage 230. The time when reception initiated by manually operating the button B 62 was last successful is stored as the scheduled reception time.

Note that orbit information (almanac, ephemeris) for the positioning information satellites is not stored in the storage device 200. The electronic timepiece 10 in this embodiment is a wristwatch, has limited storage capacity in the storage device 200, the capacity of the storage battery 130 is also limited, and continuing reception for the length of time required to acquire the orbit information is difficult. The reception process of the electronic timepiece 10 is therefore executed from a cold start when orbit information is not stored.

Control Device

The control device 300 is embodied by a CPU that controls the electronic timepiece 10. The control device 300 includes an automatic reception controller 311, a manual reception controller 312, an display controller 313, a reception setter 314, a time zone setter 315, a time zone corrector 316, and a time corrector 317.

Reception Setter

The reception setter 314 enables or disables (turns on or off) operation of the automatic reception controller 311 as described below.

More specifically, if the user pushes button A 61 for 3 seconds or more, the reception setter 314 disables operation of the automatic reception controller 311. If the user pushes the button A 61 for 3 seconds or more again, the reception setter 314 enables operation of the automatic reception controller 311.

When operation of the automatic reception controller 311 is disabled, the reception setter 314 enables operation of the automatic reception controller 311 if the user performs the display reception result operation of pushing button B 62 for 1 second or more and less than 3 seconds, or performs the force reception operation (start reception operation) of pushing button B 62 for 3 seconds or more to manually start signal reception. Note that because the reception setter 314 can determine that the display reception result operation or the force reception operation was performed when the user pushes the button B 62 for at least 1 second, operation of the automatic reception controller 311 may be enabled at that time.

Automatic Reception Controller

The automatic reception controller 311 determines if a condition for automatic reception of satellite signals is met, and if the automatic reception condition is met and operation has been enabled by the reception setter 314, operates the reception device 121 to execute the automatic reception process in the timekeeping mode.

There are two types of automatic reception processes: a scheduled automatic reception process and a light-based automatic reception process.

More specifically, the automatic reception controller 311 operates the reception device 121 to execute the scheduled automatic reception process in the timekeeping mode when the internal time reaches the scheduled reception time, which is set to a specific interval. For example, when the display time data 214 that is counted reaches the scheduled reception time, which is stored in the scheduled reception time storage 230 and set at an interval of once every three days, the automatic reception controller 311 operates the reception device 121 to run the scheduled automatic reception time process in the timekeeping mode.

When the illuminance detected by the illuminance detection device 136, which detects the illuminance of light incident to the electronic timepiece 10, reaches a specific illuminance threshold and the electronic timepiece 10 can be determined to be outdoors and exposed to daylight, the automatic reception controller 311 operates the reception device 121 to execute the light-based automatic reception process in the timekeeping mode. In this embodiment, the illuminance detection device 136 detects the illuminance incident to the electronic timepiece 10 by, for example, detecting the output voltage or the output current from the solar panel 135. Note also that the number of times the reception device 121 is operated in the light-based automatic reception process may be limited to once a day, for example. The illuminance detection device 136 is an example of the illuminance detector.

When the automatic reception process executes in this case, the reception device 121 locks onto at least one GPS satellite 100, receives satellite signals from that GPS satellite 100, and acquires time information.

Manual Reception Controller

Based on the input operation of the input device 160, the manual reception controller 312 operates the reception device 121 to run the manual reception process in the timekeeping mode or the positioning mode.

More specifically, the manual reception controller 312 operates the reception device 121 to run the manual reception process in the timekeeping mode if the user pushes the button B 62 of the input device 160 for 3 seconds or more and less than 6 seconds in the force reception operation (start reception operation) and the start reception signal for the timekeeping mode is received from the detection device 170.

When the manual reception process runs in the timekeeping mode, the reception device 121 locks onto at least one GPS satellite 100, receives satellite signals transmitted from that GPS satellite 100, and acquires time information.

If the user pushes the button B 62 of the input device 160 for 6 seconds or more in the force reception operation (start reception operation) and the start reception signal for the positioning mode is received from the detection device 170, the manual reception controller 312 operates the reception device 121 to run the manual reception process in the positioning mode.

When the manual reception process runs in the positioning mode, the reception device 121 locks onto at least three and preferably four or more GPS satellites 100, receives satellite signals transmitted from those GPS satellites 100, and acquires positioning information. The reception device 121 can also acquire time information from the received satellite signals in this mode.

Display Controller

If satellite signal reception is successful and the time information or positioning information is acquired in the automatic reception controller 311 or manual reception controller 312, or a specific time passes without receiving satellite signals succeeding (that is, if reception fails), the display controller 313 indicates the result of satellite signal reception with the hand 81.

If the user pushes the button B 62 for 1 second or more and less than 3 seconds in the display reception result operation, and a display reception result signal output from the detection device 170 is received, the display controller 313 indicates the result of satellite signal reception with the hand 81.

If operation of the automatic reception controller 311 has been disabled by the reception setter 314, the display controller 313 controls operation of the hand 91 to point to the airplane marker 93, causing the display device 141 to indicate that operation of the automatic reception controller 311 is turned off.

Note that the foregoing time that the button B 62 is pressed in the display reception result operation, that is, the time of 1 second or more and less than 3 seconds, is an example of the first time, and the time that button B is depressed in the force reception operation, that is, the time of 3 seconds or more, is an example of the second time.

Time Zone Setter

When acquiring positioning information by the reception process in the positioning mode of the manual reception controller 312 is successful, the time zone setter 315 sets the time zone data based on the acquired positioning information (latitude, longitude). More specifically, the time zone data (time zone information, that is, the time difference information) corresponding to the positioning information from the time zone data storage 220 is selected and acquired from the time zone data storage 220, and stored in the time zone data 215.

For example, because Japan Standard Time (JST) is nine hours ahead of UTC (UTC+9), when the acquired positioning information is in Japan, the time zone setter 315 reads and stores the time difference information for Japan Standard Time (+9 hours) from the time zone data storage 220 to the time zone data 215.

Time Zone Corrector

The time zone corrector 316 corrects the display time data 214 using the acquired time zone data when the time zone setter 315 sets the time zone data. As a result, the display time data 214 goes to the sum of the internal time data 213, which is UTC, plus the time zone data.

Time Corrector

When acquisition of time information by the reception process of the automatic reception controller 311 or the manual reception controller 312 is successful, the time corrector 317 stores the acquired time information in the received time data 211. As a result, the internal time data 213 and display time data 214 are corrected.

Automatic Reception Control Process

Figure 6:
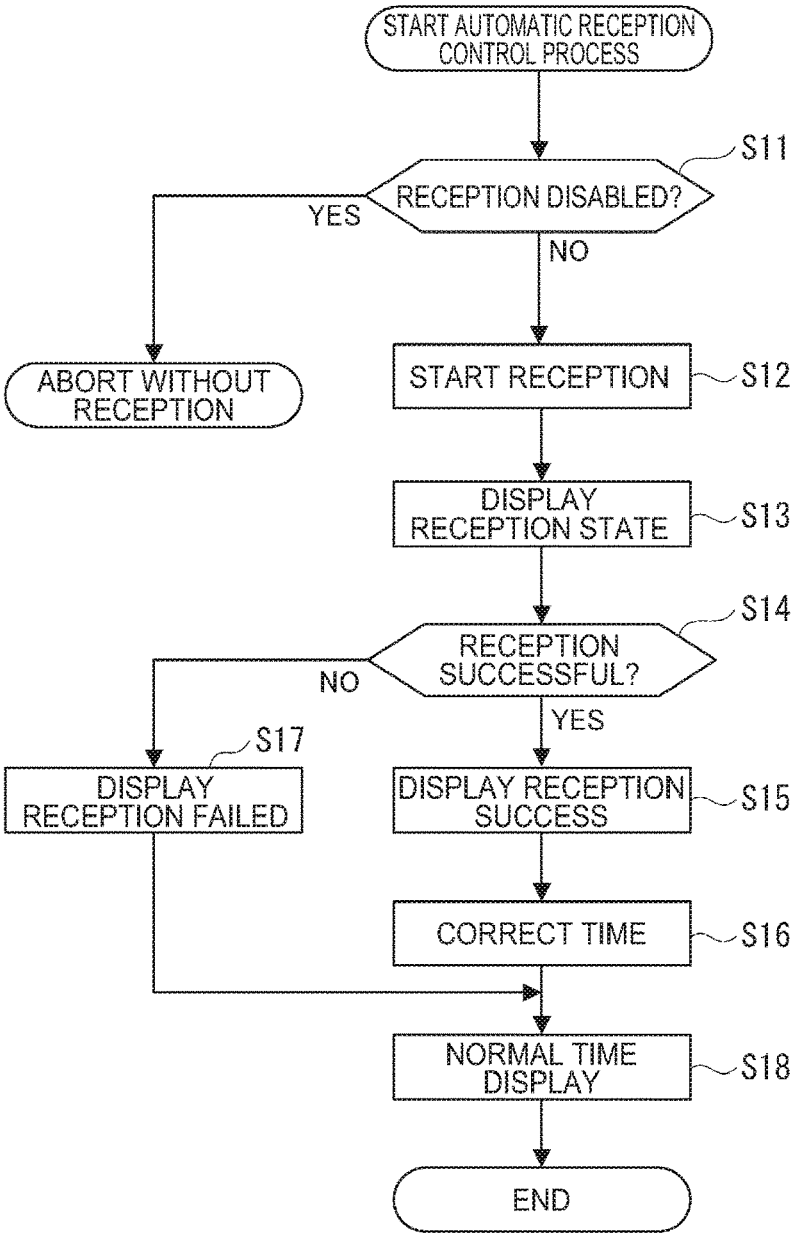
FIG. 6 is a flow chart of the automatic reception control process of the electronic timepiece according to the first embodiment.

The automatic reception control process of the electronic timepiece 10 is described next with reference to the flow chart in FIG. 6.

The automatic reception control process starts when an automatic reception condition is met. When the automatic reception control process starts, the automatic reception controller 311 determines if operation has been disabled by the reception setter 314 (S11).

If S11 returns YES, the reception process does not start and the control device 300 ends the automatic reception control process.

However, if S11 returns NO, the automatic reception controller 311 operates the reception device 121 and starts the satellite signal reception process (S12).

The display controller 313 also controls operation of the hand 91 to point to the 1 marker indicating the timekeeping mode (S13).

Next, the display controller 313 determines if satellite signals were successfully received and time information was acquired in the reception process by the automatic reception controller 311 (S14).

The automatic reception controller 311 ends the reception process if satellite signal reception was successful, or if a previously set reception time has past since the reception process started.

If S14 returns YES, the display controller 313 controls operation of the hand 81 to point to the Y marker, indicating that reception was successful (S15).

Next, the time corrector 317 stores the acquired time information in the received time data 211. As a result, the internal time data 213 and display time data 214 are corrected (S16).

However, if S14 returns NO, the display controller 313 controls operation of the hand 81 to point to the N marker, indicating that reception failed (S17).

After S16 or S17, the display controller 313 controls operation of the hand 91 to point to the power reserve marker 92 and indicate the reserve power detected by the power reserve detection device 132. More specifically, the hand 91 returns to the normal display position. The control device 300 then ends the automatic reception control process.

Manual Reception Control Process

Figure 7:
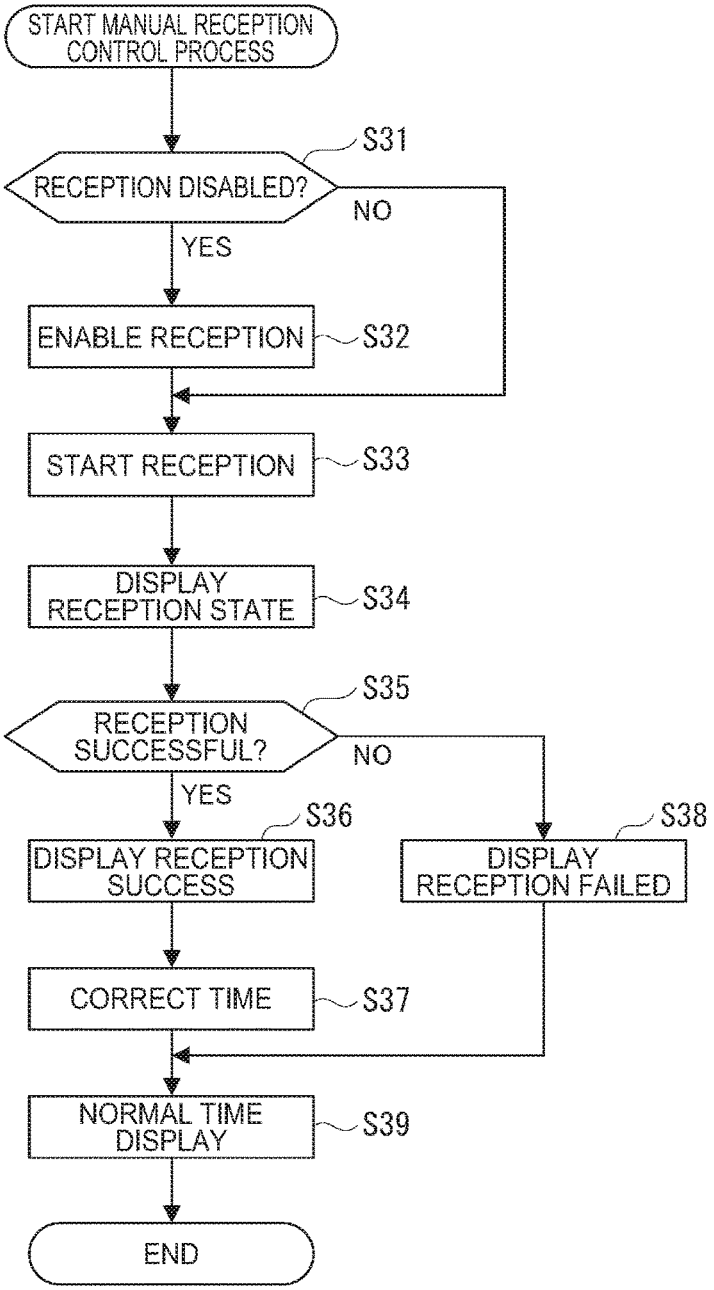
FIG. 7 is a flow chart of the manual reception control process of the electronic timepiece according to the first embodiment.

The manual reception process of the electronic timepiece 10 is described next with reference to the flow chart in FIG. 7.

The manual reception control process starts when the user presses button B 62 for 3 seconds or more. When the manual reception control process starts, the reception setter 314 determines if operation of the automatic reception controller 311 is enabled or not (S31).

IF S31 returns YES, that is, if operation of the automatic reception controller 311 is disabled, the reception setter 314 enables operation of the automatic reception controller 311 (S32). Note that in this event the timing of automatic reception by the automatic reception controller 311 is set appropriately to the reserve power of the storage battery 130 starting from when operation is enabled.

If the timing of automatic reception is set to a one-day interval or two-day interval starting from when operation is enabled, for example, the automatic reception timing is set to the time when the manual reception control process ran. Because the manual reception control process is typically started in an environment suited to reception, the likelihood of successful reception can be improved if the automatic reception controller 311 runs the reception process at the same time if the user's daily schedule is regular.

In addition, the timing of automatic reception may be set to a shorter interval when the power reserve of the storage battery 130 is high than when low. As a result, when the power reserve is high, the reception frequency can be increased (to once a day, for example) and the accuracy of the time can be increased, and if the power reserve is low, the reception frequency can be reduced (such as once every two days) and power consumption can be reduced.

After S32, or if S31 returns NO, the manual reception controller 312 operates the reception device 121 and starts the satellite signal reception process (S33).

The display controller 313 also controls operation of the hand 91 to point to the 1 marker if the reception process is running in the timekeeping mode, and the 4+ marker if in the positioning mode (S34).

Next, the display controller 313 determines if the manual reception controller 312 successfully received satellite signals and acquired the time information from the reception process (S35).

Note that if satellite signal reception was successful, or if the previously set reception time has past since the reception process started, the manual reception controller 312 ends the reception process.

If S35 returns YES, the display controller 313 controls operation of hand 81 to indicate the Y marker and indicate that reception was successful (S36).

Next, the time corrector 317 stores the acquired time information in the received time data 211. As a result, the internal time data 213 and display time data 214 are corrected (S37).

If S35 returns NO, the display controller 313 controls operation of the hand 81 to indicate the N marker and indicate that reception failed (S38).

After step S37 or S38, the display controller 313 controls operation of the hand 91 to the appropriate position in the marker 92 to show the reserve power detected by the power reserve detection device 132. In other words, the hand 91 resumes the normal operating display. The control device 300 then ends the manual reception control process.

Reception Result Display Control Process

Figure 8:
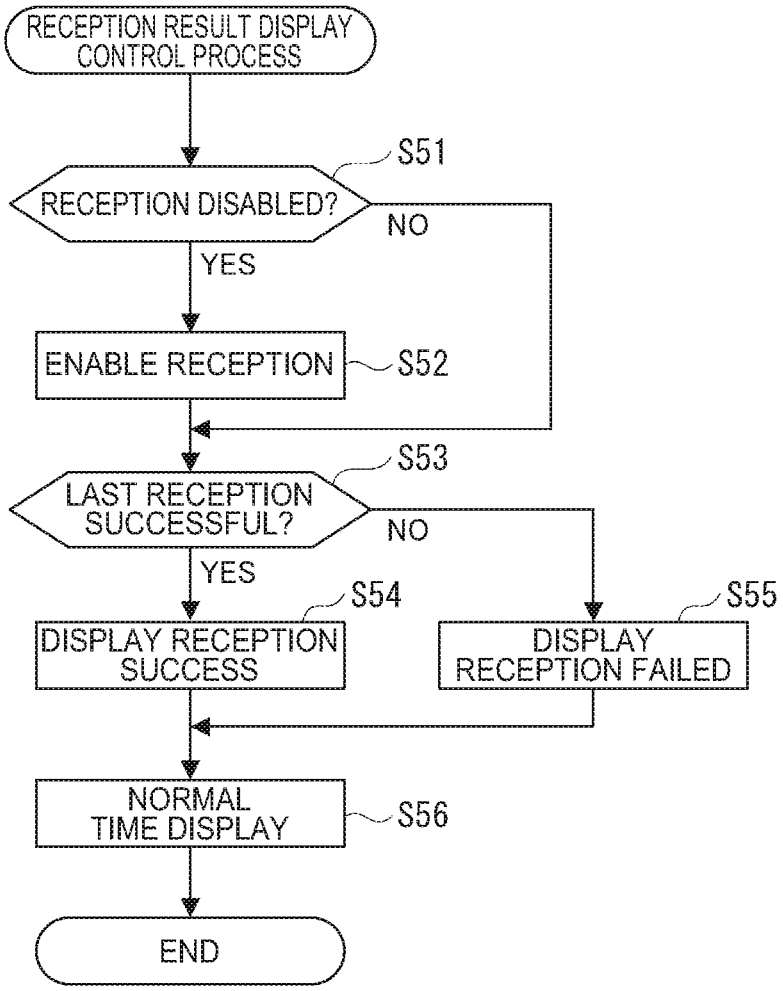
FIG. 8 is a flow chart of the reception result display control process of the electronic timepiece according to the first embodiment.

Next, reception result display control process of the electronic timepiece 10 is described next with reference to the flow chart in FIG. 8.

The reception result display control process starts when the user pushes button B 62 for 1 second or more and less than 3 seconds in the display reception result operation. When the reception result display control process starts, the reception setter 314 determines if operation of the automatic reception controller 311 is disabled (S51).

If S51 returns YES, that is, if operation of the automatic reception controller 311 is disabled, the reception setter 314 enables operation of the automatic reception controller 311 (S52).

After S52, and if S51 returns NO, the display controller 313 determines if satellite signal reception was successful and time information was acquired in the last reception process (S53).

If S53 returns YES, the display controller 313 controls operation of the hand 81 to point to the Y marker, indicating that reception was successful (S54). The display controller 313 also controls operation of the hand 91 to point to the 1 or 4+ marker to indicate the reception mode of the last reception process.

However, if S53 returns NO, the display controller 313 controls operation of the hand 81 to point to the N marker, indicating that reception failed (S55). The display controller 313 also moves the hand 91 to display the reception mode of the last reception process.

After S54 or S55, the display controller 313 controls operation of the hand 91 to point to the power reserve marker 92 and indicate the reserve power detected by the power reserve detection device 132. More specifically, the hand 91 returns to the normal display position. The control device 300 then ends the automatic reception control process.

Effect of Embodiment 1

When the user reaches the destination on an airplane and wants to start the reception process to adjust the time displayed by the electronic timepiece 10 to the current local time, or performs the display reception result operation to check the reception result, operation of the automatic reception controller 311 is enabled by these operations and operation is simple because a separate operation to enable operation of the automatic reception controller 311 is not needed.

Furthermore, operation of the automatic reception controller 311 is also enabled when the operation to start reception or to display the reception result is performed when operation of the automatic reception controller 311 is turned off.

Note that because the operation of starting reception and the display reception result operation are performed when the user decides the reception process can be run, automatically enabling operation of the automatic reception controller 311 when the start reception operation or the display reception result operation is performed allows the user to control operation as desired.

Furthermore, because operation of the automatic reception controller 311 can be enabled when the display reception result operation is performed without executing the reception process, power consumption can be reduced compared with operation of the automatic reception controller 311 being enabled when the start reception operation is performed.

The start reception operation and operations to set the reception mode also require pushing a button for a relatively long time (such as 3 seconds) to prevent the user from accidentally performing these operations. Furthermore, because the display reception result operation is started by pushing a button for a relatively short time (1 second), when operation of the automatic reception controller 311 is enabled by the display reception result operation, operation of the automatic reception controller 311 can be enabled by a shorter operation than when operation of the automatic reception controller 311 is enabled by the start reception operation or the reception mode setting operation.

The start reception operation and display reception result operation are also performed more frequently than a specific operation for turning the automatic reception controller 311 on (pressing the button A 61 for 3 seconds or more in this example), and is therefore easy for the user to remember. Because the start reception operation and display reception result operation enable operation of the automatic reception controller 311, the user can remember the operating procedure used to enable operation of the automatic reception controller 311 more easily than when operation of the automatic reception controller 311 is enabled by a special operation.

Furthermore, because the start reception operation and the display reception result operation that enable operation of the automatic reception controller 311 are both performed using button B 62, the user can more easily remember the operating method used to enable operation of the automatic reception controller 311 than when different buttons are used.

When operation of the automatic reception controller 311 is disabled, the display controller 313 indicates that operation of the automatic reception controller 311 is disabled by setting the hand 91 to the airplane marker 93. As a result, the user can easily tell if the user has forgotten to enable operation of the automatic reception controller 311, and can enable operation of the automatic reception controller 311 by performing the start reception operation or the display reception result operation.

Because the light-based reception process is executed by the automatic reception controller 311 when the output value of the illuminance detection device 136 exceeds a luminance threshold and the electronic timepiece 10 is determined to be outdoors, there is a high probability that the reception process is running while outdoors and time information can be successfully acquired.

Furthermore, even if the light-based automatic reception process does not execute when the electronic timepiece 10 is outdoors because the electronic timepiece 10 is covered by a sleeve, for example, the scheduled automated reception process can execute at the scheduled time.

Furthermore, if the user flies to another country and enables operation of the automatic reception controller 311 by performing the start reception operation and adjusting the time kept by the electronic timepiece 10 to the current local time, the time will thereafter be regularly corrected by the light-based automatic reception process or the automated reception process at the scheduled time. The correct local time can therefore be accurately displayed.

Embodiment 2

Figure 9:
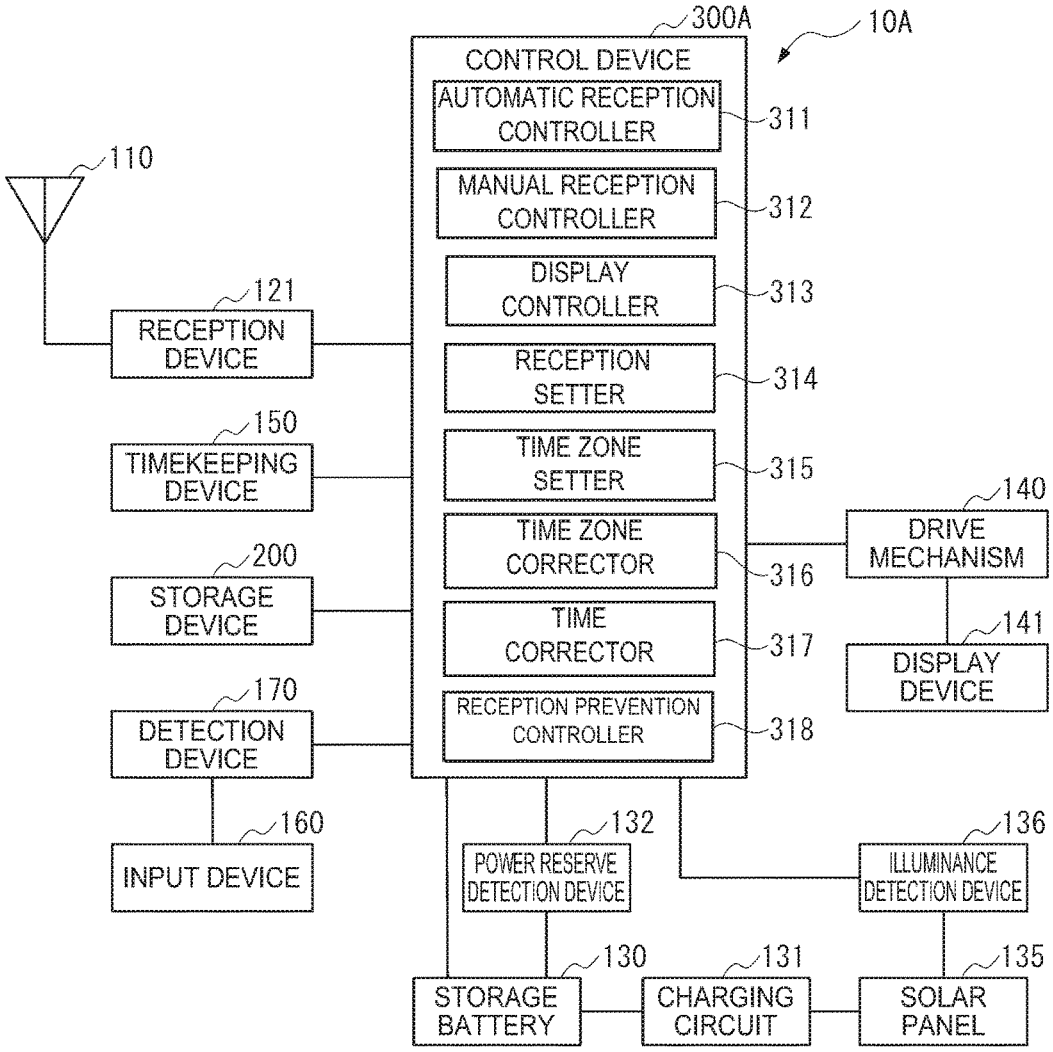
FIG. 9 is a block diagram of the electrical control circuit of the electronic timepiece according to a second embodiment.

As shown in FIG. 9, an electronic timepiece 10A according to the second embodiment has a reception prevention controller 318 that prohibits operation of the automatic reception controller 311 and the manual reception controller 312.

More specifically, the reception prevention controller 318 determines at a regular interval (such as every second) if the output of the power reserve detection device 132 is less than a previously set reserve power threshold. The reception prevention controller 318 blocks operation of the automatic reception controller 311 and manual reception controller 312 if the output of the power reserve detection device 132 is less than the power reserve threshold, and releases the block on operation of the automatic reception controller 311 and manual reception controller 312 if the output of the power reserve detection device 132 is greater than or equal to the power reserve threshold.

Note that even if operation of the automatic reception controller 311 is enabled by the reception setter 314, when operation is blocked by the reception prevention controller 318, the reception process does not execute even if the automatic reception condition is met.

Manual Reception Control Process

Figure 10:
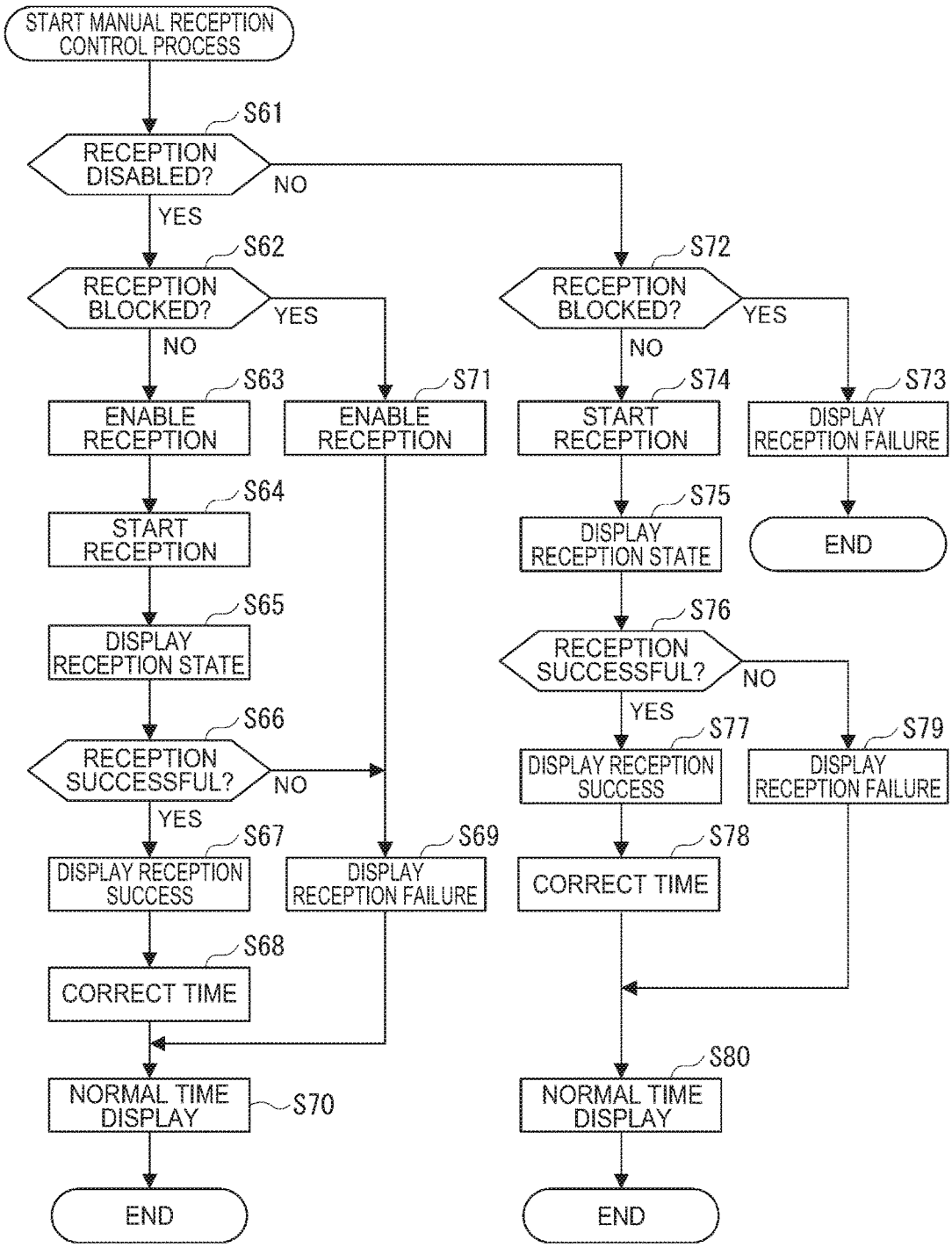
FIG. 10 is a flow chart of the manual reception control process of the electronic timepiece according to the second embodiment.

The manual reception process of the electronic timepiece 10A is described next with reference to the flow chart in FIG. 10.

When the manual reception control process starts, the reception setter 314 determines if operation of the automatic reception controller 311 is disabled (S61).

If S61 returns YES, the reception setter 314 determines if operation of the automatic reception controller 311 and manual reception controller 312 is blocked by the reception prevention controller 318 (S62).

If S62 returns NO, the reception setter 314 enables operation of the automatic reception controller 311 (S63).

Next, the manual reception controller 312 operates the reception device 121 and starts the satellite signal reception process (S64). The display controller 313 then sets the hand 91 to the 1 or the 4+ marker appropriately to whether the reception process is in the timekeeping mode or the positioning mode (S65).

Next, the display controller 313 determines if satellite signal reception was successful and time information was acquired by the reception process of the manual reception controller 312 (S66). If S66 returns YES, the display controller 313 controls operation of hand 81 to indicate the Y marker and indicate that reception was successful (S67). Next, the time corrector 317 stores the acquired time information in the received time data 211. As a result, the internal time data 213 and display time data 214 are corrected (S68). However, if S66 returns NO, the display controller 313 controls operation of the hand 81 to indicate the N marker and indicate that reception failed (S69).

After step S68 or S69, the display controller 313 controls operation of the hand 91 to the appropriate position in the marker 92 and resumes the normal operating display. The control device 300 then ends the manual reception control process.

If S62 returns YES, the reception setter 314 enables operation of the automatic reception controller 311 (S71). The display controller 313 then indicates in S69 that reception failed, resets the hand 91 to the normal display mode in S70, and the control device 300 then ends the manual reception control process.

If S61 returns NO, the manual reception controller 312 determines if operation of the automatic reception controller 311 and manual reception controller 312 is blocked by the reception prevention controller 318 (S72).

If S72 returns YES, the display controller 313 sets the hand 81 to N to indicate reception failed (S73). The control device 300 then ends the manual reception control process.

If S72 returns NO, the manual reception controller 312 operates the reception device 121 and starts the satellite signal reception process (S74). The display controller 313 then sets the hand 91 to the 1 or 4+ marker appropriate to whether the reception process ran in the timekeeping mode or the positioning mode (S75).

Next, the display controller 313 determines if satellite signal reception was successful and time information was acquired by the reception process of the manual reception controller 312 (S76). If S76 returns YES, the display controller 313 sets the hand 81 to the Y marker to indicate reception was successful (S77). The time corrector 317 then stores the acquired time information in the received time data 211. As a result, the internal time data 213 and display time data 214 are corrected (S78). However, if S76 returns NO, the display controller 313 sets the hand 81 to the N marker to indicate that reception failed (S79).

After S78 or S79, the display controller 313 sets the hand 91 to the marker 92 and resumes the normal display mode (S80). The control device 300 then ends the manual reception control process.

When operation of the automatic reception controller 311 is turned off and a start reception signal is received, the reception setter 314 enables operation of the automatic reception controller 311 whether or not operation of the automatic reception controller 311 is blocked by the reception prevention controller 318 (S63, S71).

Note that when operation of the automatic reception controller 311 is turned off and a display reception result signal is received, the reception setter 314 enables operation of the automatic reception controller 311 whether or not operation of the automatic reception controller 311 is blocked by the reception prevention controller 318.

Note that other aspects of the configuration of the electronic timepiece 10A are the same as the electronic timepiece 10 according to the first embodiment.

Effect of Embodiment 2

In addition to the same effects as the first embodiment described above, this second embodiment has the following effect.

If operation of the automatic reception controller 311 is enabled by the reception setter 314 but the output value of the power reserve detection device 132 drops below the power reserve threshold and operation is then blocked by the reception prevention controller 318, the reception process does not execute even if an automatic reception condition is met. Furthermore, if operation is blocked by the reception prevention controller 318, the manual reception controller 312 does not execute the reception process even if the force reception operation is performed. As a result, a system shutdown caused by the reception process executing when there is not enough reserve power can be avoided.

Furthermore, if the start reception signal or the display reception result signal is received when operation of the automatic reception controller 311 is turned off, the reception setter 314 enables operation of the automatic reception controller 311 even if operation of the automatic reception controller 311 is blocked by the reception prevention controller 318. The user therefore does not need to perform an operation enabling operation of the automatic reception controller 311 again after the storage battery 130 is charged. Furthermore, if the storage battery 130 is charged and the output of the power reserve detection device 132 exceeds the power reserve threshold, the automatic reception controller 311 can immediately start running the reception process.

Embodiment 3

The condition for enabling operation of the automatic reception controller 311 in the manual reception control process is different in the electronic timepiece according to the third embodiment than the electronic timepiece 10A according to the second embodiment. Other aspects of its configuration are the same as the electronic timepiece 10A.

Figure 11:
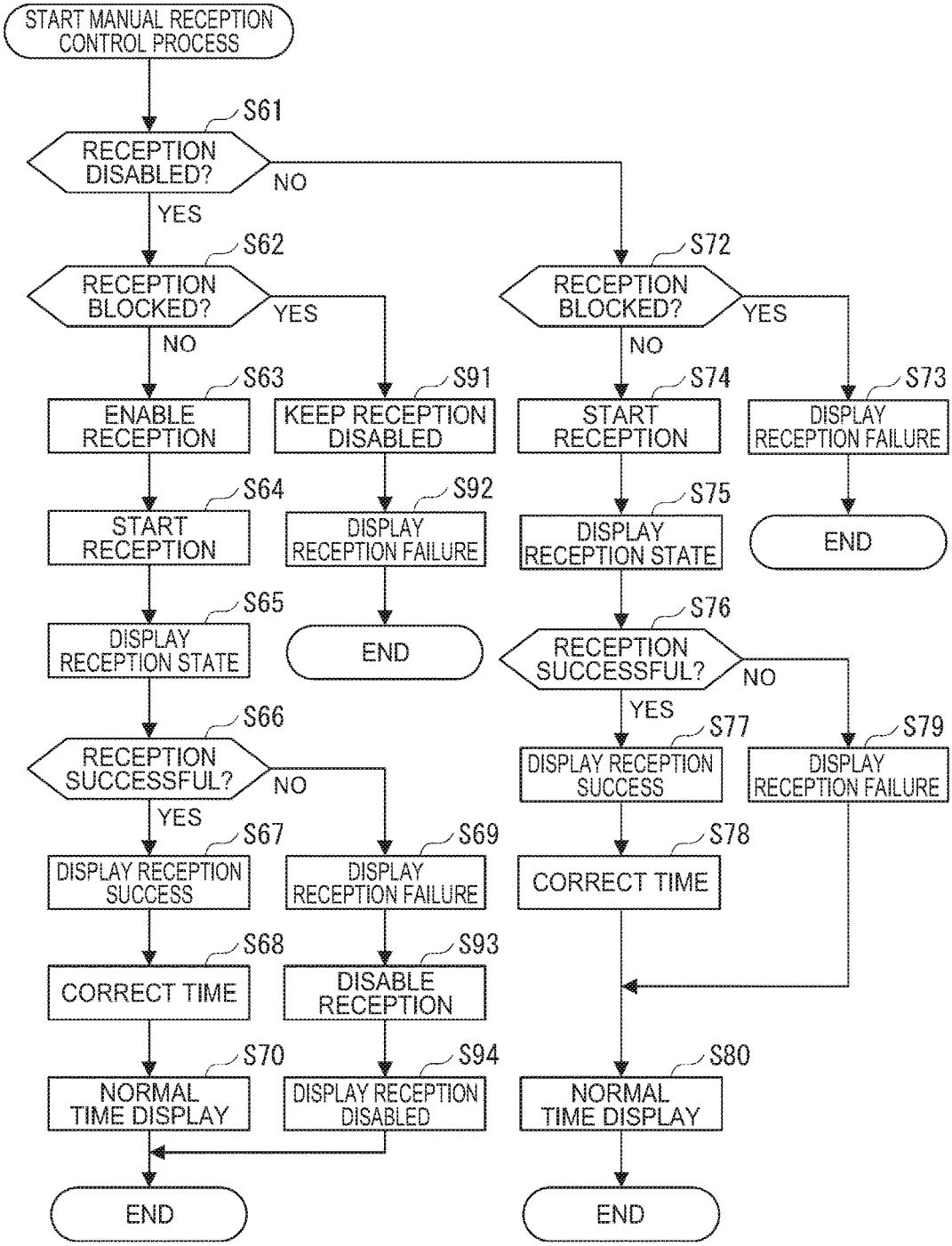
FIG. 11 is a flow chart of the manual reception control process of the electronic timepiece according to a third embodiment.

FIG. 11 is a flow chart of the manual reception control process according to the third embodiment. Note that steps S61 to S70, and S72 to S80 are the same as in the second embodiment, and further description thereof is omitted.

In the manual reception control process of the third embodiment, if S62 returns YES, the reception setter 314 does not enable operation of the automatic reception controller 311 (leaves the automatic reception controller 311 off) (S91). The display controller 313 then sets the hand 81 to the N to show that reception failed (S92). Next, the control device 300 ends the manual reception control process.

After S66 returns NO, and the display controller 313 moves the hand 81 to indicate reception failed in S69, the reception setter 314 turns operation of the automatic reception controller 311 off (S93). Next, the display controller 313 sets the hand 91 to the airplane marker 93 to indicate that operation of the automatic reception controller 311 is turned off (S94). The control device 300 then ends the manual reception control process.

As described above, when operation of the automatic reception controller 311 is turned off and operation of the automatic reception controller 311 is not blocked by the reception prevention controller 318, the reception setter 314 enables operation of the automatic reception controller 311 when a start reception signal is received (S63). When operation of the automatic reception controller 311 is disabled and operation of the automatic reception controller 311 is blocked by the reception prevention controller 318, operation of the automatic reception controller 311 remains disabled by the reception setter 314 when a start reception signal is received (S91).

Likewise, when operation of the automatic reception controller 311 is turned off and operation of the automatic reception controller 311 is not blocked by the reception prevention controller 318, the reception setter 314 enables operation of the automatic reception controller 311 when a display reception result signal is received. When operation of the automatic reception controller 311 is turned off and operation of the automatic reception controller 311 is blocked by the reception prevention controller 318, the does not enable operation of the automatic reception controller 311 when the display reception result signal is received.

When operation of the automatic reception controller 311 is turned off and the reception process executed by the manual reception controller 312 in response to a start reception signal is successful (S66 returns YES), the reception setter 314 enables operation of the automatic reception controller 311 (S63). If operation of the automatic reception controller 311 is off and the manual reception controller 312 fails at reception (S66 returns NO), operation of the automatic reception controller 311 remains off (S93).

Effect of Embodiment 3

In addition to the same effects as the second embodiment described above, this third embodiment has the following effect.

When operation of the automatic reception controller 311 is turned off and operation of the automatic reception controller 311 is blocked by the reception prevention controller 318, the reception setter 314 continues to block operation of the automatic reception controller 311 when a start reception signal or display reception result signal is received.

More specifically, because operation of the automatic reception controller 311 is not enabled if operation of the automatic reception controller 311 is blocked, the user can avoid mistakenly thinking that the automatic reception controller 311 can execute the reception process.

If the reception process of the manual reception controller 312 is successful, the reception setter 314 enables operation of the automatic reception controller 311.

If the reception process of the manual reception controller 312 is successful and the operating environment of the electronic timepiece 10 does not change, the reception process can be expected to be successful when the automatic reception condition is met and the automatic reception controller 311 runs the reception process. As a result, the likelihood of successful reception by the automatic reception controller 311 can be improved by enabling operation of the automatic reception controller 311 when reception by the manual reception controller 312 is successful.

When the reception process of the manual reception controller 312 fails, the reception setter 314 blocks operation of the automatic reception controller 311.

When the reception process of the manual reception controller 312 fails and the location of the electronic timepiece 10 does not change, the reception process can be expected to fail if the automatic reception controller 311 runs the reception process when the automatic reception condition is met. Therefore by blocking operation of the automatic reception controller 311 when the reception process of the manual reception controller 312 fails, the automatic reception controller 311 executing the reception process in an environment unsuited to reception can be avoided, and power consumption can be reduced.

Other Examples

The invention is not limited to the embodiments described above, and can be modified and improved in many ways without departing from the scope of the accompanying claims.

The reception setter 314 enables operation of the automatic reception controller 311 in the foregoing embodiments when operation of the automatic reception controller 311 is disabled but a start reception operation or display reception result operation is performed, but the invention is not so limited. For example, a configuration that enables operation of the automatic reception controller 311 only when one of the start reception operation and the display reception result operation is performed is also conceivable.

Furthermore, in addition to the start reception operation and the display reception result operation, operation of the automatic reception controller 311 can be turned on by pushing the button A 61 for 3 seconds or more in the foregoing embodiments, but the invention is not so limited. For example, a configuration that enables operation of the automatic reception controller 311 only when the start reception operation or the display reception result operation is performed is also conceivable.

The start reception operation and the display reception result operation are both performed by pushing the same button B 62 in the embodiments described above, but the invention is not so limited. More specifically, the start reception operation and the display reception result operation may be performed by pushing a same button other than button B 62. The start reception operation and the display reception result operation may also be performed by pushing different buttons.

The display controller 313 in the foregoing embodiments uses the hand 91 to indicate that operation of the automatic reception controller 311 is disabled when operation of the automatic reception controller 311 is disabled, but the invention is not so limited. More specifically, a configuration that does not indicate that operation of the automatic reception controller 311 is disabled is also conceivable.

Furthermore, when operation of the automatic reception controller 311 is enabled in the foregoing embodiments, the display controller 313 normally indicates the remaining battery capacity with the hand 91, but the invention is not so limited. For example, a dedicated marker meaning that operation of the automatic reception controller 311 is enabled may be provided on the third subdial 90, and the hand 91 may be controlled to point to this marker.

The automatic reception controller 311 in the foregoing embodiments executes a scheduled automatic reception process and a light-based reception process, but the invention is not so limited. More specifically, the automatic reception controller 311 may be configured to execute only the scheduled automatic reception process or the light-based reception process, or to start the reception process under different conditions in the scheduled automatic reception process and light-based reception process. A configuration having multiple conditions for executing the automatic reception process, and enabling the user to select the automatic reception conditions, is also conceivable.

The foregoing embodiments are described with reference to a GPS satellite 100 as an example of a positioning information satellite, but invention is not so limited. Other examples of positioning information satellites include Global Navigation Satellite Systems (GNSS) such as Galileo (EU), GLONASS (Russia), and Beidou (China). The invention can also be used with geostationary satellites in satellite-based augmentation systems (SBAS), and quasi-zenith satellites in radio navigation satellite systems (RNSS) that can only search in specific regions. The invention can also be used in configurations that receive and process satellite signals from multiple systems.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An electronic timepiece comprising:

a receiver configured to receive satellite signals;

a user interface;

a detector configured to output a setting instruction for setting an automatic reception state to enable or to disable based on a first operation of the user interface and for setting a manual reception instruction based on a second operation of the user interface, the first operation and the second operation being different operations;

a manual reception controller configured to operate the receiver and execute a manual reception process if the manual reception instruction is output from the detector regardless of the automatic reception state;

an automatic reception setter configured to set the automatic reception state based on the setting instruction; and an automatic reception controller configured to:

execute a reception process that receives the satellite signals if the automatic reception state is set to enable and an automatic reception condition is met, and not execute the reception process if the automatic reception state is set to disable, wherein the automatic reception setter sets the automatic reception state to enable if the automatic reception state is set to disable and the manual reception instruction is output.

2. The electronic timepiece described in claim 1, wherein:

the detector detects a signal from the user interface instructing displaying a reception result, the detector outputs a display reception result signal if the signal from the user interface is detected; and the automatic reception setter enables operation of the automatic reception controller if operation of the automatic reception controller is disabled and the display reception result signal is received from the detector.

3. The electronic timepiece described in claim 2, wherein:
the user interface includes an operating button,
the detector detects the signal from the user interface instructing displaying the reception result if the operating button is pushed for a previously set first time, and
the detector detects the signal from the user interface instructing starting reception if the operating button is pushed for a second time that is longer than the first time.

4. The electronic timepiece described in claim 1, wherein:
the automatic reception setter keeps the automatic reception state set to disable if the reception process of the manual reception controller fails and the automatic reception state is set to disable.

5. The electronic timepiece described in claim 1, further comprising:
a battery;
a power reserve detector configured to detect a capacity remaining in the battery; and
a reception prevention controller configured to block operation of the automatic reception controller if the output of the power reserve detector is less than a previously set power reserve threshold, and to cancel blocking operation of the automatic reception controller if the output of the power reserve detector is greater than or equal to the power reserve threshold;
the automatic reception controller not executing the reception process even if the automatic reception condition is met if operation is enabled by the reception setter and operation is blocked by the reception prevention controller; and
the automatic reception setter setting the automatic reception state to enable whether or not operation of the automatic reception controller is blocked by the reception prevention controller if the setting instruction for setting the automatic reception state to enable or the manual reception instruction output from the detector is received and the automatic reception state is set to disable.

6. The electronic timepiece described in claim 1, further comprising:
a battery;
a power reserve detector configured to detect a capacity remaining in the battery; and
a reception prevention controller configured to block operation of the automatic reception controller if the output of the power reserve detector is less than a previously set power reserve threshold, and to cancel blocking operation of the automatic reception controller if the output of the power reserve detector is greater than or equal to the power reserve threshold;
the automatic reception controller not executing the reception process even if the automatic reception condition is met if operation is enabled by the reception setter and operation is blocked by the reception prevention controller; and
the automatic reception setter setting the automatic reception state to enable if the setting instruction for setting the automatic reception state to enable or the manual reception instruction output from the detector is received if the automatic reception state is set to disable and operation of the automatic reception controller is not blocked by the reception prevention controller, and
the automatic reception setter keeping the automatic reception state set to disable if the setting instruction for setting the automatic reception state to enable or the manual reception instruction signal output from the detector is received and the automatic reception state is set to disable and operation of the automatic reception controller is blocked by the reception prevention controller.

7. The electronic timepiece described in claim 1, further comprising:
a display; and
a display controller configured to display that the automatic reception state is set to disable on the display if the automatic reception state is set to disable.

8. The electronic timepiece described in claim 1, further comprising:
a luminance detector configured to detect a brightness of light incident to the electronic timepiece;
the automatic reception controller executing the reception process if the luminance detected by the luminance detector is greater than or equal to a previously set luminance threshold.

9. The electronic timepiece described in claim 1, further comprising:
a timekeeper configured to keep time;
the automatic reception controller executing the reception process if the kept time of the timekeeper reaches a previously set specific time.

10. The electronic timepiece described in claim 1, wherein when the automatic reception state is set to disabled, the timepiece is set to airplane mode.

11. An electronic timepiece comprising:
a receiver configured to receive satellite signals;
a user interface;
a detector configured to detect a signal from the user interface, and output a setting instruction for setting an automatic reception state to enable or to disable based on a first operation of the user interface and a display reception result instruction for displaying a last reception result based on a second operation of the user interface, the first operation and the second operation being different operations;
an automatic reception setter configured to set the automatic reception state based on the setting instruction;
an automatic reception controller configured to:
execute a reception process if the automatic reception state is set to enable and an automatic reception condition is met, and
not execute the reception process if the automatic reception state is set to disable; and
a display reception result controller configured to display a last reception result if the display reception result instruction is output regardless of the automatic reception state,
the automatic reception setter setting the automatic reception state to enable if the automatic reception state is set to disable and the display reception result instruction is output.

12. A control method of an electronic timepiece including a receiver configured to receive satellite signals;
a user interface;
a detector configured to output a setting instruction for setting an automatic reception state to enable or to disable based on a first operation of the user interface and for setting a manual reception instruction based on a second operation of the user interface, the first operation and the second operation being different operations;

a manual reception controller configured to execute a reception process if the manual reception instruction is output from the detector regardless of the automatic reception state;

an automatic reception setter configured to set the automatic reception state based on the setting instruction; and an automatic reception controller configured to execute a reception process if the automatic reception state is set to enable and an automatic reception condition is met, and not execute the reception process if the automatic reception state is set to disable;

the control method comprising:

disabling operation of the automatic reception controller; and enabling operation of the automatic reception controller if the automatic reception state is set to enable and operation of the automatic reception controller is disabled.

* * * * *